United States Patent [19]

Rhodes et al.

[11] Patent Number: 5,070,131

[45] Date of Patent: Dec. 3, 1991

[54] GEAR OIL VISCOSITY INDEX IMPROVERS

[75] Inventors: Robert B. Rhodes, Houston, Tex.; Rudolf J. Eckert, Huffelsheim, Fed. Rep. of Germany; Donald E. Loeffler, Houston, Tex.

[73] Assignee: Shell Oil Company, Houston, Tex.

[21] Appl. No.: 590,417

[22] Filed: Sep. 28, 1990

[51] Int. Cl.[5] ..... C08K 5/01

[52] U.S. Cl. ..... 524/484; 524/481; 524/486; 524/502; 524/534; 524/572; 524/573

[58] Field of Search ..... 524/481, 484, 486, 502, 524/534, 572, 573

[56] References Cited

U.S. PATENT DOCUMENTS

| | | | |
|---|---|---|---|
| 4,077,893 | 3/1978 | Kiovsky | 525/285 |
| 4,082,680 | 4/1978 | Mitacek | 252/59 |
| 4,116,917 | 9/1978 | Eckert | 524/504 |
| 4,141,847 | 2/1979 | Kiovsky | 252/51.5 |
| 4,156,673 | 5/1979 | Eckert | 260/33.6 |
| 4,358,565 | 11/1982 | Eckert | 525/280 |
| 4,427,834 | 1/1984 | Martin | 525/280 |
| 4,490,267 | 12/1984 | Eckert | 525/280 |
| 4,788,361 | 11/1988 | Olson et al. | 585/10 |
| 4,942,210 | 7/1990 | Kuntz | 526/348.7 |
| 4,970,254 | 11/1990 | Willis et al. | 525/314 |

*Primary Examiner*—Paul R. Michl
*Assistant Examiner*—Edward J. Cain
*Attorney, Agent, or Firm*—James O. Okorafor

[57] ABSTRACT

A gear oil composition is provided, the composition comprising a hydrogenated star conjugated diolefin polymer having arms with weight average molecular weights between about 3,000 and about 15,000. Such star polymers are effective as viscosity index improvers, and yet are sufficiently shear stable for service in gear oil lubricants.

34 Claims, No Drawings

GEAR OIL VISCOSITY INDEX IMPROVERS

FIELD OF THE INVENTION

This invention relates to gear oil compositions and in particular, to gear oil compositions which comprise polymeric viscosity index improvers.

BACKGROUND OF THE INVENTION

Many polymeric viscosity index improvers are available for lubricating oils but most of these viscosity index improvers do not have sufficiently high shear stabilities to be acceptable in gear oil service. Commercial gear oils viscosity index improvers include polyisobutylenes and polymethacrylates. To be acceptable gear oil viscosity index improvers, both of these types of polymers must be presheared to a uniform low molecular weight. This preshearing adds expense to the manufacturing process. Further, these presheared polymers are not efficient as thickeners, and a relatively large amount of either is required to impart an acceptable viscosity index improvement to a base gear oil.

Another prior art gear oil viscosity index improver is disclosed in U.S. Pat. No. 4,082,680. This patent describes a relatively low molecular weight hydrogenated butadiene-styrene diblock copolymer. The polymer is 30 to 44 weight percent butadiene and has a molecular weight within the range of 12,000 to 20,000. This is a lower molecular weight version of a diblock copolymer which is known to be useful as a viscosity index improver for motor oils. Like the presheared viscosity index improvers, the low molecular weight results in a relatively low thickening efficiency. A high concentration is therefore required to impart an acceptable viscosity index for multigrade gear oils.

Hydrogenated conjugated diolefin polymers having a star, or radial configuration are known to be useful as viscosity index improvers for motor oils, but, again, these motor oil viscosity index improvers are not acceptable as gear oil viscosity index improvers due to low shear stability. Such motor oil viscosity index improvers are disclosed in U.S. Pat. No. 4,156,673. The star polymers are generally oil soluble to much higher molecular weights than linear counterparts. Because higher molecular weight polymers are more efficient thickeners this results in less polymer being required. This results in a significant cost advantage for the use of hydrogenated radial conjugated diolefin polymers as motor oil lubricating oil viscosity index improvers. The higher molecular weight star polymer is also disclosed as being more shear stable than linear counterparts, but shear stabilities sufficient for gear oil service are not disclosed.

It is therefore an object of the present invention to provide a gear oil composition which has excellent shear stability, an acceptable viscosity over a wide temperature range and which requires a lower level of polymer additive than the gear oil compositions which comprise prior art polymeric viscosity index improvers. In another aspect it is an object of this invention to provide a method to improve the viscosity index of a gear oil and also maintain an acceptable shear stability.

SUMMARY OF THE INVENTION

The objects of this invention are achieved by providing a gear oil composition which comprises a hydrogenated star polymer comprising at least four arms comprising, before hydrogenation, polymerized conjugated diolefins, each arm having a weight average molecular weight within the range of about 3,000 to about 15,000.

This invention also provides a method to improve the viscosity index of a gear oil by incorporating into the gear oil composition from about 1 to about 15 parts by weight, based on 100 parts by weight of gear oil composition, of a hydrogenated radial polymer comprising at least four arms comprising, before hydrogenation, polymerized conjugated diolefins, each arm having a weight average molecular weight within the range of about 3,000 to about 15,000.

The arms of the radial polymer may comprise other types of monomers, including in particular, monoalkenyl arenes.

DETAILED DESCRIPTION OF THE INVENTION

In the preparation of gear oils, various mineral oils are employed. Generally, these are of petroleum origin and are complex mixtures of many hydrocarbon compounds. Preferably, the mineral oils are refined products such as are obtained by well-known refining processes, such as by hydrogenation, by polymerization, by solvent extraction, by dewaxing, etc. Frequently, the oils have a 40° C. kinematic viscosity as determined according to ASTM D445 in the range of about 100 to 400 cSt and a kinematic viscosity at 100° C. of about 10 to 40 cSt. The oils can be of paraffinic, naphthenic, or aromatic types, as well as mixtures of one or more types. Many suitable lubricating compositions and components are available as commercial products.

The concentration of the hydrogenated star-shaped polymers in such gear oils may vary between wide limits with amounts of between about 0.1 and about 20% by weight, especially from about 0.15 to about 10%, more preferably from about 0.5 to about 2% w being used. The amounts are based on the weight of the composition.

The polymers of the instant invention are generally produced by the process comprising the following reaction steps:

(a) polymerizing one or more conjugated dienes and, optionally, one or more monoalkenyl arene compounds, in solution, in the presence of an ionic initiator to form a living polymer;

(b) reacting the living polymer with a polyalkenyl coupling agent to form a star-shaped polymer; and (c) hydrogenating the star-shaped polymer to form a hydrogenated star-shaped polymer. The living polymers produced in reaction step (a) of the present process are the precursors of the hydrogenated polymer chains which extend outwardly from the poly(polyalkenyl coupling agent) nucleus.

Living polymers may be prepared by anionic solution polymerization of conjugated dienes and, optionally, monoalkenyl arene compounds in the presence of an alkali metal or an alkali-metal hydrocarbon, e.g. sodium naphthalene, as anionic initiator. The preferred initiator is lithium or a monolithium hydrocarbon. Suitable lithium hydrocarbons include unsaturated compounds such as allyl lithium, methallyl lithium; aromatic compounds such as phenyllithium, the tolyllithiums, the xylyllithiums and the naphthyllithiums and in particular the alkyl lithiums such as methyllithium, ethyllithium, propyllithium, butyllithium, amyllithium, hexyllithium, 2-ethylhexyllithium and n-hexadecyllithium. Secondary-butyllithium is the preferred initiator. The initiators may be added to the polymerization mixture in two or more stages optionally together with additional monomer. The living polymers are olefinically and, optionally, aromatically unsaturated.

The living polymers obtained by reaction step (a), which are linear unsaturated living polymers, are prepared from one or more conjugated dienes, e.g. $C_4$ to $C_{12}$ conjugated dienes and, optionally, one or more monoalkenyl arene compounds.

Examples of suitable conjugated dienes include butadiene(1,3-butadiene); isoprene; 1,3-pentadiene(piperylene); 2,3-dimethyl-1,3-butadiene; 3butyl-1,3-octadiene; 1-phenyl-1,3-butadiene; 1,3-hexadiene; and 4-ethyl-1,3-hexadiene with butadiene and/or isoprene being preferred. Apart from the one or more conjugated dienes the living polymers may also be partly derived from one or more monoalkenyl arene compounds.

When 1,3-butadiene is utilized as the predominate monomer, the polymerization is preferably controlled such that at least 55 percent of the butadiene polymerizes by 1,2 addition. Polybutadienes which are of lower levels of 1,2 addition result in a gear oil with inferior low temperature performance. The amount of 1,2 addition of butadienes can be controlled by means well known in the art, such as utilization of use of polar solvents or polar modifiers. Utilization of tetrahydrofuran as a cosolvent can result in 55 percent or more 1,2 addition of butadienes.

Preferred monoalkenyl arene compounds are the monovinyl aromatic compounds such as styrene, monovinylnaphthalene as well as the alkylated derivatives thereof such as o-, m- and p-methylstyrene, alphamethylstyrene and tertiary-butylstyrene. Styrene is the preferred monoalkenyl arene compound due to its wide availability at a reasonable cost. If a monoalkenyl arene compound is used in the preparation of the living polymers it is preferred that the amount thereof be below about 50% by weight, preferably about 3% to about 50%.

The living polymers may also be partly derived from small amounts of other monomers such as monovinylpyridines, alkyl esters of acrylic and methacrylic acids (e.g. methyl methacrylate, dodecyclmethacrylate, octadecyclmethacrylate), vinyl chloride, vinylidene chloride, monovinyl esters of carboxylic acids (e.g. vinyl acetate and vinyl stearate).

The living polymers may be living homopolymers, living copolymers, living terpolymers, living tetrapolymers, etc. The living homopolymers may be represented by the formula A-M, wherein M is a carbanionic group, e.g. lithium, and A is polybutadiene or polyisoprene. Living polymers of isoprene are the preferred living homopolymers. The living copolymers may be represented by the formula A-B-M, wherein A-B is a block, random or tapered copolymer such as poly(butadiene/isoprene), poly(butadiene/styrene) or poly(isoprene/styrene). Such formulae, without further restriction, do not place a restriction on the arrangement of the monomers within the living polymers. For example, living poly(isoprene/styrene) copolymers may be living polyisoprene-polystyrene block copolymer, living polystyrene-polyisoprene block copolymers, living poly(isoprene/styrene) random copolymers, living poly(isoprene/styrene)tapered copolymers or living poly(isoprene/styrene/isoprene) block copolymers. Living poly(butadiene/styrene/isoprene) terpolymer is an example of a living terpolymer which is acceptable.

The living copolymers may be living block copolymers, living random copolymers or living tapered copolymers. The living block copolymer may be prepared by the step-wise polymerization of the monomers e.g. by polymerizing isoprene to form living polyisoprene followed by the addition of the other monomer, e.g. styrene, to form a living block copolymer having the formula polyisoprene-polystyrene-M, or styrene may be polymerized first to form living polystyrene followed by addition of isoprene to form a living block copolymer having the formula polystyrene-polyisoprene-M.

In a preferred embodiment, the arms are diblock arms having conjugated diolefin outter blocks and monoalkenyl arene inner blocks. The arms are therefore polymerized by polymerizing blocks of conjugated diolefins, and then polymerizing blocks of monoalkenyl arenes. The arms would then be coupled at the end of the monoalkenyl arene blocks.

Incorporating monoalkenyl arenes in general, and in this preferred manner in particular, results in a polymer which can be finished as a crumb. A polymer which is finishable as a crumb, as opposed to a viscous liquid, is much more convenient to handle.

The solvents in which the living polymers are formed are inert liquid solvents such as hydrocarbons e.g. aliphatic hydrocarbons, such as pentane, hexane, heptane, oxtane, 2-ethylhexane, nonane, decane, cyclohexane, methylcyclohexane or aromatic hydrocarbons, e.g. benzene, toluene, ethylbenzene, the xylenes, diethylbenzenes, propylbenzenes. Cyclohexane is preferred. Mixtures of hydrocarbons e.g. lubricating oils may also be used.

The temperature at which the polymerization is carried out may vary between wide limits such as from −50° C. to 150° C., preferably from about 20° to about 80° C. The reaction is suitably carried out in an inert atmosphere such as nitrogen and may be carried out under pressure e.g. a pressure of from about 0.5 to about 10 bars.

The concentration of the initiator used to prepare the living polymer may also vary between wide limits and is determined by the desired molecular weight of the living polymer.

The weight average molecular weight of the living polymers prepared in reaction step (a) are from about 3,000 to about 15,000 with weight average molecular weights of from about 5,000 to about 12,000 being preferred. Higher molecular weight arms are not sufficiently shear stable whereas lower molecular weight arms result in a star polymer which does not alter gear oil viscosity without an excessive amount of polymer added.

The living polymers produced in reaction step (a) are then reacted, in reaction step (b), with a polyalkenyl coupling agent. Polyalkenyl coupling agents capable of forming star-shaped polymers are known. See U.S. Pat. No. 3,985,830; Canadian Patent No. 716,645; and British Patent No. 1,025,295 which are incorporated herein by reference. They are usually compounds having at least two non-conjugated alkenyl groups. Such groups are usually attached to the same or different electron-withdrawing groups e.g. an aromatic nucleus. Such compounds have the property that at least two of the alkenyl groups are capable of independent reaction with different living polymers and in this respect are different from conventional conjugated diene polymerizable monomers such as butadiene, isoprene etc. Such compounds may be aliphatic, aromatic or heterocyclic. Examples of aliphatic compounds include the polyvinyl and polyallyl acetylenes, diacetylenes, phosphates and phosphites as well as the dimethacrylates, e.g. ethylene dimethyacrylate. Examples of suitable heterocyclic compounds include divinyl pyridine and divinyl thiophene. The preferred coupling agents are the polyalkenyl aromatic compounds and the most preferred are the polyvinyl aromatic compounds. Examples of such compounds include those aromatic compounds, such as benzene, toluene, xylene, anthracene, naphthalene and durene which are substituted by at least two alkenykl groups preferably directly attached thereto. Examples include the polyvinyl benzenes e.g. divinyl, trivinyl and tetravinyl benzenes, divinyl, trivinyl and tetravinyl ortho-, meta- and para-xylenes, divinyl naphthalene, divinyl ethyl benzene, divinyl biphenyl, diisobutenyl benzene, diisopropenyl benzene and diisopropenyl biphenyl. The preferred aromatic compounds are represented by the formula: $A\text{-}(CH=CH_2)_x$ wherein A is an optionally substituted aromatic nucleus and x is an integer of at least 2. Divinyl benzene, in particular metadivinyl benzene, is the most preferred aromatic compound. Pure or technical grade divinylbenzene (containing various amounts of other monomers, e.g. styrene and ethyl styrene) may be used. The coupling agents may be used in admixture with small amounts of added monomers which increase the size of the nucleus, e.g. styrene or alkylated styrene. In this case, the nucleus may be described as a poly(dialkenyl coupling agent-/monoalkenyl aromatic compound)nucleus, e.g. a poly(divinylbenzene/monoalkenyl aromatic compound)nucleus.

The polyalkenyl coupling agent should be added to the living polymer after the polymerization of the monomers is substantially complete, i.e. the agent should only be added after substantially all of the monomer has been converted to living polymers.

The amount of polyalkenyl coupling agent added may vary between wide limits but preferably at least 0.5 mole is used per mole of living polymer. Amounts of from 1 to 15 moles, preferably from 1.5 to 5 moles are preferred. The amount, which may be added in two or more stages, is usually such so as to convert at least 80 or 85% w of the living polymers into star-shaped polymers.

The reaction step (b) may be carried out in the same solvent as for reaction step (a). A list of suitable solvents is given above. The reaction step (b) temperature may also vary between wide limits such as from 0° to 150° C., and is preferably from 20° to 120° C. The reaction may also take place in an inert atmosphere such as nitrogen and under pressure. Pressures of from 0.5 to 10 bars are preferred.

The star-shaped polymers prepared in reaction step (b) are characterized by having a dense center or nucleus of cross-linked poly(polyalkenyl coupling agent) and a number of arms of substantially linear unsaturated polymers extending outwardly therefrom. The number of arms may vary considerably but is typically between 4 and 25, preferably from about 7 to about 15.

Applicant has found that increasing the number of arms employed in the instant invention significantly improves both the thickening efficiency and the shear stability of the polymer since it is then possible to prepare a gear oil VI improver having a relatively high molecular weight (resulting in increased thickening efficiency) without the necessity of excessively long arms (resulting in an acceptable shear stability).

Star-shaped polymers, which are still "living", may then be deactivated or "killed", in known manner, by the addition of a compound which reacts with the carbanionic end group. As examples of suitable deactivators may be mentioned, compounds with one or more active hydrogen atoms such as water, alcohols (e.g. methanol, ethanol, isopropanol, 2-ethylhexanol) or carboxylic acids (e.g. acetic acid), compounds with one active halogen atom, e.g. a chlorine atom (e.g. benzyl chloride, chloromethane), compounds with one ester group and carbon dioxide. If not deactivated in this way, the living star-shaped polymers may be killed by the hydrogenation step (c).

Before being killed, the living star-shaped polymers may be reacted with further amounts of monomers such as the same or different dienes and/or monoalkenyl arene compounds of the types discussed above. The effect of this additional step, apart from increasing the number of polymer chains, is to produce a further living star-shaped polymer having at least two different types of polymer chains. For example, a living star-shaped polymer derived from living polyisoprene may be reacted with further isoprene monomer to produce a further living star-shaped polymer having polyisoprene chains of different number average molecular weights. Alternatively, the living star-shaped polyisoprene homopolymer may be reacted with styrene monomer to produce a further living star-shaped copolymer having both polyisoprene and polystyrene homopolymer chains. Thus it can be seen that by different polymer chains is meant chains of different molecular weights and/or chains of different structures. The additional arms must have number average molecular weights within the molecular weights specified above. These further polymerizations may take place under substantially the same conditions as described for reaction step (a) of the process.

In step (c), the star-shaped polymers are hydrogenated by any suitable technique. Suitably at least 80%, preferably at least 90%, most preferably at least 95% of the original olefinic unsaturation is hydrogenated. If the star-shaped polymer is partly derived from a monoalkenyl arene compound, then the amount of aromatic unsaturation which is hydrogenated, if any, will depend on the hydrogenation conditions used. However, preferably less than 10%, more preferably less than 5% of such aromatic unsaturation is hydrogenated. If the poly(polyalkenyl coupling agent)nucleus is a poly(-polyalkenyl aromatic coupling agent)nucleus, then the aromatic unsaturation of the nucleus may or may not be hydrogenated again depending upon the hydrogenation conditions used. The molecular weights of the hydrogenated star-shaped polymers correspond to those of the unhydrogenated star-shaped polymers.

A preferred hydrogenation process is the selective hydrogenation process shown in U.S. Pat. No. 3,595,942, incorporated herein by reference. In this process, hydrogenation is conducted, preferably in the same solvent in which the polymer was prepared, utilizing a catalyst comprising the reaction product of an aluminum alkyl and a nickel or cobalt carboxylate or alkoxide. A favored catalyst is the reaction product formed from triethyl aluminum and nickel octoate.

The hydrogenated star-shaped polymer is then recovered in solid form from the solvent in which it is hydrogenated by any convenient technique such as by evaporation of the solvent. Alternatively, an oil, e.g. a gear oil, may be added to the solution and the solvent stripped off from the mixture so formed to produce concentrates. Easily handleable concentrates are produced even when the amount of hydrogenated star-shaped polymer therein exceed 10% w. Suitable concentrates contain from 10 to 60% w of the hydrogenated star-shaped polymer.

In addition to the radial polymers of this invention, the shear-stable gear oil compositions can comprise one or more other additives known to those skilled in the art, such as antioxidants, pour point depressants, dyes, detergents, etc. Gear oil additives containing phosphorus and sulfur are commonly used.

Because the shearing stress in a gear oil service is much more severe than in an automobile engine, the use of lower molecular weight polymers which are more shear-stable than the higher molecular weight polymers is essential to the formulation of multi-grade gear oils that can be depended upon to stay in-grade after considerable use. Methods known in the art to impart dispersancy and/or detergency functions to viscosity index improvers may be incorporated in the gear oil viscosity index improvers of this invention. Such methods include metalation and functionalization with nitrogen containing functional groups as disclosed in U.S. Pat. No. 4,145,298, incorporated herein by reference.

The gear oil compositions of the present invention provide excellent shear stability, and provide for multi-grade gear oil compositions with less polymer required than prior art compositions. These compositions do not require preshearing, which lowers the cost of manufacturing these compositions. The polymers of this invention are also more soluble in mineral oils, which permits preparation of the viscosity improvers in concentrates at higher concentrations. Although the polymers of the present invention are excellent viscosity index improvers for many applications, such as motor oils, power stearing oils, tractor oils, shock absorber oils, hydraulic fluids, doorcheck oil, bearing oils and the like, they are particularly suited for gear oil compositions due to the requirement for extremely high shear stability.

EXAMPLES OF THE INVENTION

Star configuration polymers having polyisoprene arms of molecular weights of about 9,900; 10,500; 12,000; 16,000; 21,000; and 35,000 were prepared and hydrogenated, hydrogenating greater than 98% of the initial ethylenic unsaturation. These polymers are designated Star Polymers 1 through 6 respectively.

The Star Polymers were prepared by polymerizing isoprene from a cyclohexane solution using secondary butyllithium as an initiator. The ratio of initiator to isoprene was varied to result in the designated arm molecular weights. The living arms were then coupled with divinyl benzene with a mole ratio of divinyl benzene to lithium of about 3. Hydrogenation was performed using a $Ni(octoate)_2$ and triethyl aluminum hydrogenation catalyst at about 65° C. The hydrogenation catalyst was then extracted by washing the solution with a 1% w aqueous solution of citric acid and then with water.

The star polymers were then dissolved in mineral oil to form a concentrate with varying amounts of polymer, depending on the solubility of the polymers.

Gear oil compositions which approximate 80W-140 grade specifications were prepared including each of the above star polymers, two commercial gear oil viscosity index improvers and a commercial motor oil viscosity index improver. The commercial motor oil viscosity index improver was Shellvis® 50. The commercial gear oil viscosity index improvers are Lubrizol 3174 and Acryloid 1017. They are respectively, polymers of isobutene and methacrylates. Each is believed to have a uniform molecular weight as a result of preshearing the polymers. Pour point depressants Acryloid 154 or Hitec E-672 were included in the gear oil formulations. A commercial additive package for heavy duty gear oils, Anglamol 6020A, was also included in the compositions. Table 1 lists the amounts of the components in each gear oil composition, the viscosity at 100° C. and the Brookfield viscosity at −26° C. Specifications for 80W-140 gear oil are a minimum of 24 cSt viscosity at 100° C. and a maximum Brookfield of 1500P at −26° C. Although not all of the blends fell within these specifications, each was close, and could have been adjusted by slight variations to the combination of lube stocks utilized.

TABLE 1

| | Star arm M.W. | Concentrate % wt. polymer | Composition, % wt. | | | | | | | | | |
|---|---|---|---|---|---|---|---|---|---|---|---|---|
| | | | a | b | c | d | e | f | g | h | i | j |
| Star Polymer 1 | 9,900 | 45 | 12.0 | 10.7 | | | | | | | | |
| Star Polymer 2 | 10,500 | 45 | | | 9.7 | | | | | | | |
| Star Polymer 3 | 12,000 | 20 | | | | 22.0 | | | | | | |
| Star Polymer 4 | 16,000 | 15 | | | | | 22.0 | | | | | |
| Star Polymer 5 | 21,000 | 15 | | | | | | 19.0 | | | | |
| Star Polymer 6 | 35,000 | 8 | | | | | | | 21.0 | | | |
| SHELLVIS 50 | | 6 | | | | | | | | 25.5 | | |
| Acryloid 1017 | | 67 | | | | | | | | | 28.0 | |
| Lubrizol 3174 | | 100 | | | | | | | | | | 33.0 |
| Acryloid 154 | | — | | | | | | | 1.0 | — | 1.0 | 1.0 |
| Hitec E-672 | | — | 0.5 | 0.5 | 0.5 | 0.5 | 0.5 | 1.0 | — | 1.0 | — | — |
| HVI250 Neutral MQ | | | 72.0 | 72.3 | 70.0 | 55.0 | 53.0 | 62.5 | 53.5 | 40 | 51.5 | 12.5 |
| HVI100 Neutral MQ | | | 0 | 0 | 0 | 0 | 0 | 0 | 0 | 0 | 0 | 46 |
| HVI150 Bright Stock | | | 8.0 | 9.0 | 12.3 | 15.0 | 17.0 | 10.0 | 17.0 | 26.0 | 12.0 | 0 |
| Anglamol 6020A | | | 7.5 | 7.5 | 7.5 | 7.5 | 7.5 | 7.5 | 7.5 | 7.5 | 7.5 | 7.5 |
| Properties | | | | | | | | | | | | |
| % wt. VII polymer | | | 5.4 | 4.8 | 4.4 | 4.4 | 3.3 | 2.9 | 1.7 | 1.5 | 17.1 | 33.0 |
| Viscosity at 100° C., cSt | | | 28.5 | 24.8 | 24.1 | 24.1 | 23.8 | 23.1 | 23.7 | 25.5 | 25.7 | 25.1 |
| Brookfield at −26° C., P | | | 1408 | 1400 | 1620 | 1408 | 1391 | 1228 | 1690 | 1530 | 1450 | 1500 |

The shear stability of the star polymers and the prior art viscosity index improvers were detemined utilizing a Gear Lubricant Shear Stability Test performed by Autoresearch Laboratories, Inc. This test uses a preloaded gear set similar to a hypoid differential driven at 3500 rpm, with a lubricant temperature of about 82° C. A charge of 3 pints of oil is required, and a 10 milliliter sample of oil is taken at intervals to monitor the viscosity charge.

The Shear Stability Index (SSI) was calculated as the percent of the original viscosity which was contributed by the polymer which was lost due to the shear. Table 2 summarizes the results of the shear stability tests and the calculation of the SSI.

TABLE 2

| | Blend | | | | | | | | | |
|---|---|---|---|---|---|---|---|---|---|---|
| | a | b | c | d | e | f | g | h | i | j |
| | VI improver | | | | | | | | | |
| | Star Poly. | Star Poly. | Star Poly. | Star Poly. | Star Poly. | Star Poly. | Star Poly. | SHELLVIS 50 | Acryloid 1017 | Lubrizol 3174 |
| (arm m. wt) | (9,900) | (9,900) | (10,500) | (12,000) | (16,000) | (21,000) | (35,000) | | | |
| Blend vis. cSt | 28.45 | 24.79 | 24.13 | 24.09 | 23.81 | 23.14 | 23.73 | 25.48 | 25.65 | 25.05 |
| Blend vis. w/o polymer cSt | 8.60 | 8.70 | 9.10 | 10.30 | 10.60 | 9.74 | 9.9 | 13.10 | 9.8 | 5.40 |
| Vis. due to polymer (A) | 19.85 | 16.09 | 15.03 | 13.79 | 13.21 | 13.40 | 13.83 | 12.38 | 15.85 | 19.65 |
| ALI Shear test after 48 hrs. vis. cSt | 24.65 | 21.23 | 20.38 | 20.84 | 17.90 | 13.21 | 13.58 | 13.99 | 23.65 | 23.58 |
| Vis. loss cSt (B) | 3.80 | 3.56 | 3.75 | 3.25 | 5.91 | 9.93 | 10.15 | 11.49 | 2.00 | 1.47 |
| Shear stability index (B/A) % | 19.1 | 22.1 | 25.0 | 23.6 | 44.8 | 74.0 | 73.5 | 92.5 | 12.6 | 7.5 |

The excellent shear stability of the two commercial gear oil viscosity index improvers is evident from the SSIs of Table 2. Only 12.6 and 7.5 percent of the viscosity increase attributable to these viscosity index improvers were lost in the shear stability test. The commercial motor oil viscosity index improver and star polymers having arms of 16,000 molecular weight or more have shear stability indexes of 44% or greater. These are unacceptable for gear oil service due to the resultant change in composition viscosity. Hydrogenated star configuration polymers of conjugated diolefins wherein the polymer's arms have molecular weights less than 16,000 have shear stability indexes of 25% or less. These polymers are acceptable viscosity index improvers for gear oil service.

We claim:

1. A gear oil composition having improved shear stability index essentially consisting of gear oil, a viscosity index improver comprising a hydrogenated star polymer comprising at least four arms, the arms comprising, before hydrogenation, polymerized conjugated diolefin monomer units and the arms having a number average molecular weight within the range of about 3,000 to about 15,000.

2. The gear oil composition of claim 1 wherein the conjugated diolefin is butadiene.

3. The gear oil composition of claim 1 wherein the conjugated diolefin is isoprene.

4. The gear oil composition of claim 1 wherein the conjugated diolefin is a combination of isoprene and butadiene.

5. The gear oil composition of claim 1 wherein the arms have a weight average molecular weight within the range of about 5,000 to about 12,000.

6. The gear oil composition of claim 1 wherein the star polymer has a shear stability index of 25% or less.

7. The gear oil composition of claim 1 wherein the star polymer arms are coupled with a polyalkenyl coupling agent.

8. The gear oil composition of claim 7 wherein the polyalkenyl coupling agent is divinyl benzene.

9. The gear oil composition of claim 1 wherein the composition comprises from about 0.15 to about 20 percent by weight of hydrogenated star polymer.

10. The gear oil composition of claim 1 wherein the composition comprises from about 0.5 to about 10 percent by weight of hydrogenated star polymer.

11. The gear oil composition of claim 1 further comprising one or more components selected from the group consisting of antioxidants, pour point depressants, dyes and detergents.

12. The gear oil composition of claim 1 wherein the gear oil composition is a multigrade gear oil.

13. The composition of claim 1 wherein at least on the average of one arm of the hydrogenated star polymer is a arm having at least one hydrogenated conjugated diolefin block and at least one monoalkenyl arene block.

14. The composition of claim 13 wherein a monoalkenyl arene block is an inside block and hydrogenated conjugated diolefin block is an outer block.

15. The composition of claim 14 wherein essentially all of the arms are diblock arms.

16. The gear oil composition of claim 5 wherein the star polymer is one having a shear stability index of 25% or less.

17. The gear oil composition of claim 16 wherein the star polymer arms are coupled with a polyalkenyl coupling agent.

18. The gear oil composition of claim 17 wherein the polyalkenyl coupling agent is divinyl benzene.

19. The gear oil composition of claim 18 wherein the composition comprises from about 0.5 to about 10 percent by weight of star polymer.

20. The gear oil composition of claim 19 wherein the arms of the star polymer have a number average molecular weight within the range of about 5,000 to about 12,000.

21. The gear oil composition of claim 20 wherein the conjugated diolefin is isoprene.

22. The gear oil composition of claim 20 wherein the conjugated diolefin is butadiene and the butadiene is polymerized with 55 percent or more 1,2 addition.

23. The gear oil composition of claim 20 wherein the conjugated diolefin is a combination of butadiene and isoprene.

24. A method to prepare a multigrade gear oil composition comprising the step of incorporating into the gear oil composition from about 1 to about 15 parts by weight, based on 100 parts by weight gear oil composition of a hydrogenated radial polymer comprising at least four arms comprising, before hydrogenation, polymerized conjugated diolefins, the arms having a weight average molecular weight within the range of about 5,000 to about 15,000.

25. The method of claim 24 wherein the arms have a weight average molecular weight within the range of about 5,000 to about 12,000.

26. The method of claim 24 wherein the star polymer has a shear stability index of about 25% or less.

27. The method of claim 24 wherein the conjugated diolefin is isoprene.

28. The method of claim 24 wherein the conjugated diolefin is butadiene and the butadiene is polymerized with 55 percent or more 1,2 addition.

29. The method of claim 24 wherein the conjugated diolefin is a combination of isoprene and butadiene.

30. The method of claim 24 wherein the star polymer arms are coupled with a polyalkenyl coupling agent.

31. The method of claim 30 wherein the polyalkenyl coupling agent is divinyl benzene.

32. The method of claim 30 wherein the star polymer has a shear stability index of about 25% or less.

33. The method of claim 32 wherein the conjugated diolefin is isoprene.

34. The method of claim 32 wherein the conjugated diolefin is butadiene which has been polymerized with 55 percent or more 1,2 addition.

* * * * *